US006050810A

United States Patent [19]

Huang

[11] Patent Number: 6,050,810

[45] Date of Patent: Apr. 18, 2000

[54] LIGHTER HAVING A SAFETY MECHANISM

[76] Inventor: Ying Fang Huang, No. 2, Lane 22, Sec. 2, San Hsi Road, Taichung, Taiwan, 404

[21] Appl. No.: 09/273,738

[22] Filed: Mar. 22, 1999

[51] Int. Cl.[7] ..... F23D 14/28

[52] U.S. Cl. ..... 431/153; 431/344; 431/255; 431/345

[58] Field of Search ..... 431/153, 255, 431/344, 345; 251/77, 353

[56] References Cited

U.S. PATENT DOCUMENTS 4,502,465 3/1985 Yoshinaga et al. ..... 431/344

*Primary Examiner*—Carl D. Price

*Attorney, Agent, or Firm*—Charles E Baxley Esq.

[57] ABSTRACT

A lighter includes a housing having a valve seat, and a trigger for actuating an igniting device. A plug is slidably received in the housing and biased to engage with the valve seat. A latch is pivotally secured in the housing and has a hook for engaging with the trigger and for preventing the trigger from being actuated. A knob may disengage the latch from the trigger when the knob is moved relative to the housing and may engage with the plug for disengaging the plug from the valve seat. The trigger may not be actuated before the latch is disengaged from the trigger.

9 Claims, 4 Drawing Sheets

LIGHTER HAVING A SAFETY MECHANISM

BACKGROUND OF THE INVENTION

1. Field of the Invention

The present invention relates to a lighter, and more particularly to a lighter having a safety mechanism.

2. Description of the Prior Art

Typical lighters comprise a tank for receiving the pressurized gas, a lighter device for lighting the gas, and a trigger for triggering the lighter device to ignite the gas. The gas of the lighter may be easily ignited by simply depressing the trigger. No safety mechanism is provided for preventing the gas from being ignited inadvertently by the children.

The present invention has arisen to mitigate and/or obviate the afore-described disadvantages of the conventional lighters.

SUMMARY OF THE INVENTION

The primary objective of the present invention is to provide a lighter having a safety mechanism for preventing the gas of the lighter from being ignited by the children inadvertently.

In accordance with one aspect of the invention, there is provided a lighter comprising a housing including a valve seat, a container received in the housing for receiving gas, an igniting device received in the housing, a trigger slidably received in the housing for actuating the igniting device, a plug slidably received in the housing and including an aperture, means for biasing the plug to engage with the valve seat and to prevent the gas from flowing into the aperture of the plug, the gas being allowed to flow into the aperture of the plug when the plug is moved against the biasing means, a latch pivotally secured in the housing and including a hook for engaging with and for stopping the trigger, and a knob slidably received in the housing and engaged with the plug for disengaging the plug from the valve seat. The knob may disengage the hook of the latch from the trigger when the knob is moved relative to the housing.

The housing includes a tube and a sleeve slidably engaged on the tube, the plug includes a front end secured in the tube and a rear end for engaging with the tube, the knob includes an orifice for slidably receiving the sleeve which has a projection for moving the tube and the plug to disengage the plug from the valve seat when the sleeve is moved by the knob.

The plug includes an inlet communicating the aperture of the plug with the valve seat. The housing includes a bearing for slidably supporting the tube and for engaging with the sleeve to limit a relative movement of the sleeve relative to the housing.

The knob includes an extension, the latch includes an arm and a limb and a space formed between the arm and the limb for receiving the extension of the knob and for allowing the knob to act on the latch.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
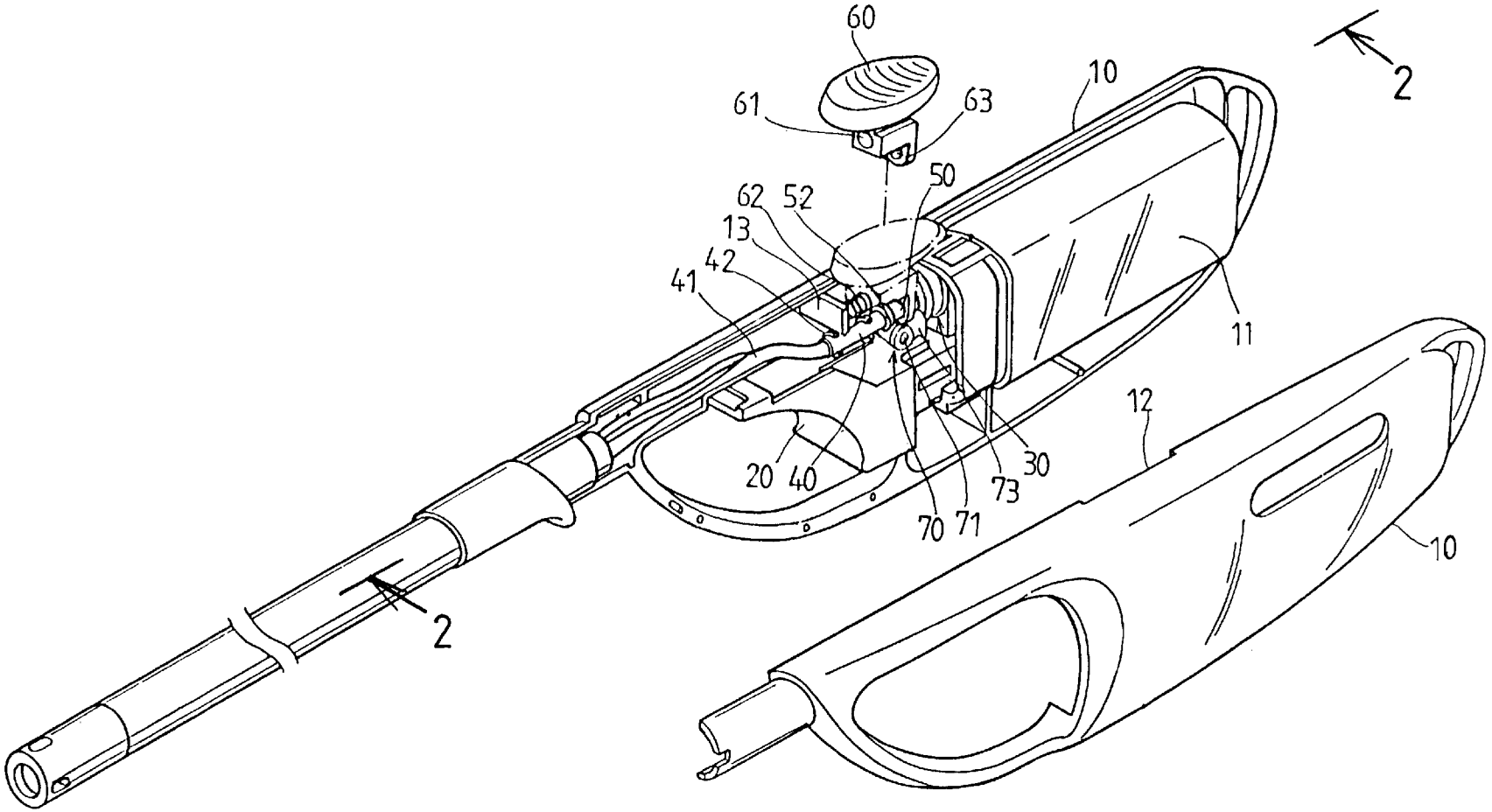
FIG. 1 is an exploded view of a lighter in accordance with the present invention.
Figure 2:
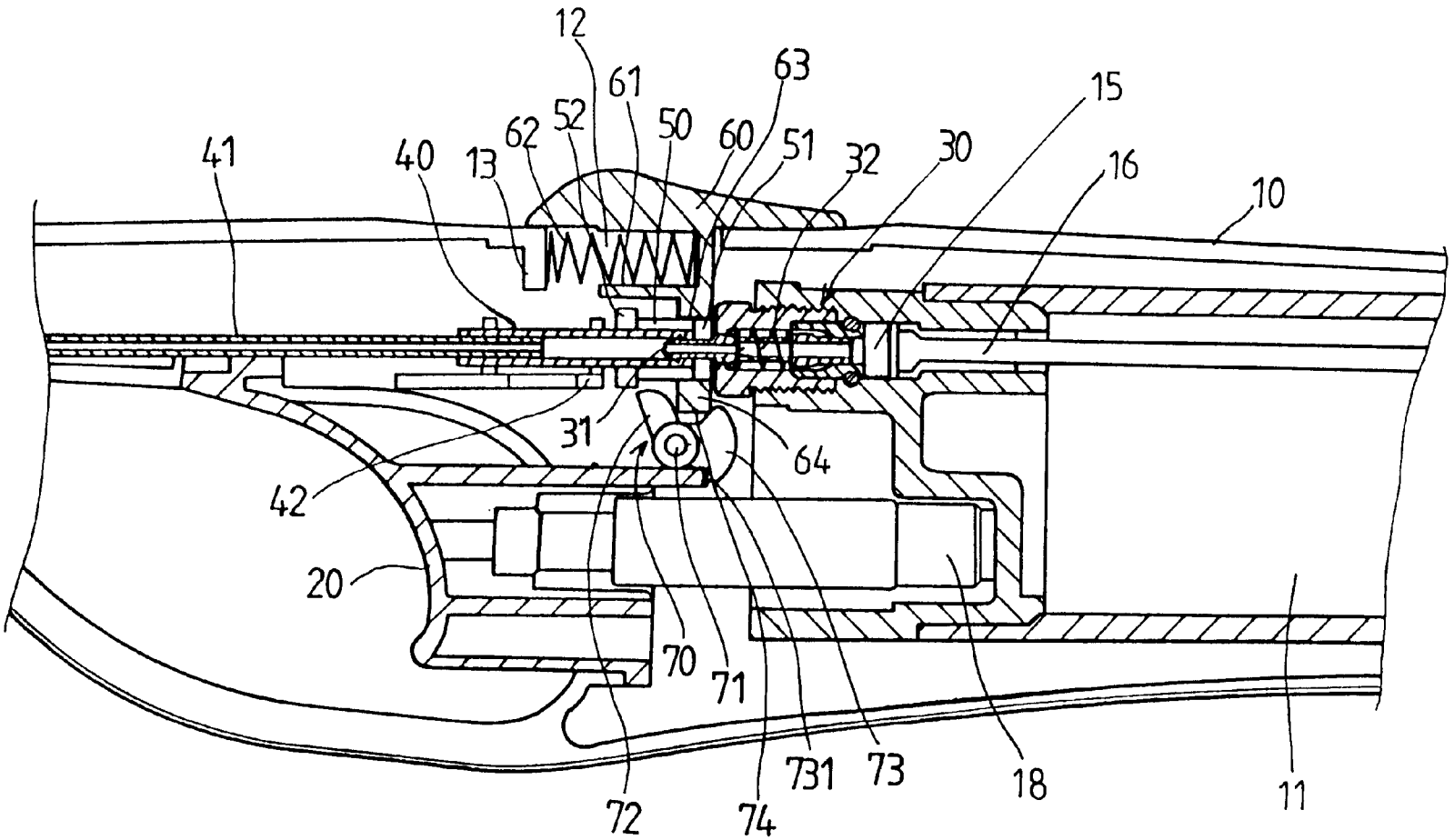
FIG. 2 is a partial cross sectional view taken along lines 2—2 of FIG. 1.

Referring to the drawings, and initially to FIGS. 1 and 2, a lighter in accordance with the present invention comprises a housing 10 including two half members secured together by such as welding processes or by adhesive materials or by fasteners. The housing 10 preferably includes a gun shape for allowing the lighter to be easily operated. A container 11 is received in the housing 10, and preferably received in the rear portion of the housing 10, for containing the pressurized gas or the liquid gas. The housing 10 includes a channel 12 formed in the upper portion for slidably receiving a knob 60 and includes a stop 13 provided in front of the knob 60. The knob 60 includes a cavity 61 facing forward for receiving a spring 62 which is engaged between the knob 60 and the stop 13 of the housing 10 for biasing the knob 60 rearward along the channel 12 of the housing 10. The knob 60 includes an orifice 63 formed in an extension 64 that is extended downward from the knob 60. The housing 10 includes a tube 40 slidably received in the middle portion of the housing 10 by a ring or a bearing 42 and close to the front portion thereof, and includes a pipe 41 having a rear end engaged in the tube 40 and having a front end extended to the front end of the housing 10 for supplying the gas to the front end of the housing 10. A igniting device 18, such as the typical flint type or the typical electrical type igniting device, is disposed in the housing 10, and a trigger 20 is slidably disposed in front of the igniting device 18 for triggering the igniting device 18.

Figure 3:
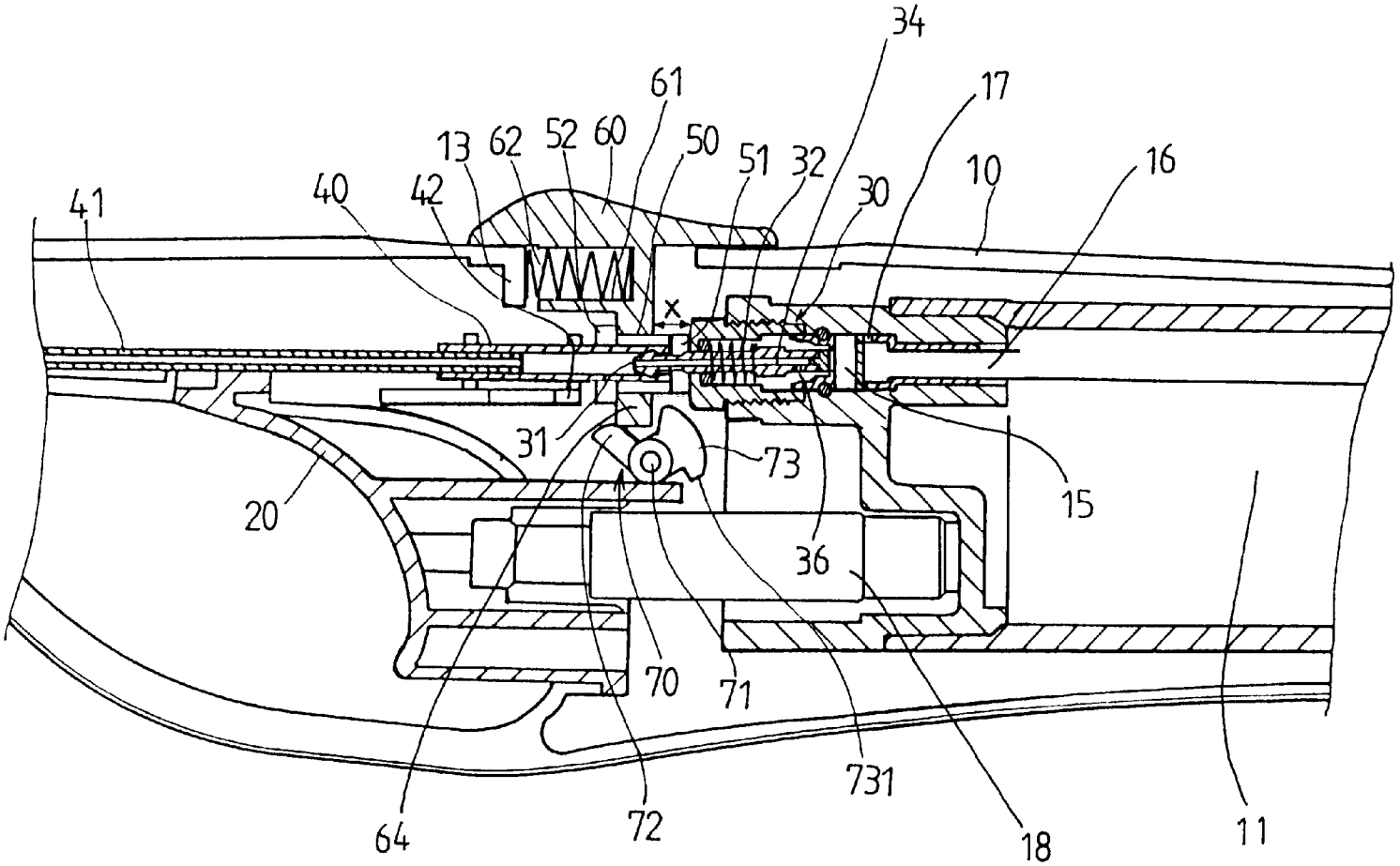
FIGS. 3 and 4 are partial cross sectional views similar to FIG. 2, illustrating the operation of the lighter.

The housing 10 includes a casing 30 secured in the middle portion and close to the gas container 11. The casing 30 includes a chamber 15 formed in the middle portion thereof and communicating with the container 11 with a passage 16 via a number of peripheral punctures 17 (FIG. 3), for allowing the gas to flow from the container 11 into the chamber 15 of the casing 30. The casing 30 includes a valve seat 38 provided in front of the chamber 15 of the casing 30 (FIG. 4) and includes an opening 39 communicating with the chamber 15 of the casing 30. The valve seat 38 may also be directly formed in the housing 10 instead of being formed in the casing 30. A plug 31 includes a front end slidably received in the tube 40 and includes an aperture 34 and an inlet 36 (FIGS. 3, 4) communicating with the chamber 15 and the opening 39 of the casing 30 for receiving the gas therefrom. It is preferable that the front end of the plug 31 is secured in the tube 40 and moves in concert with the tube 40. A spring 32 is engaged between the plug 31 and the casing 30 for biasing the rear end of the plug 31 to engage with the valve seat 38 and to block the opening 39 of the casing 30 (FIGS. 2, 3). A sleeve 50 is slidably engaged on the tube 40 and slidably received in the orifice 63 of the knob 60 and has a front end 52 for engaging with the bearing 42 (FIG. 4) and has a rear projection 51 extended radially inward therefrom for engaging with the tube 40 and for moving the tube 40 and the plug 31 forward against the spring 32. The bearing 42 is provided for engaging with the front end 52 of the sleeve 50 to limit the forward movement of the sleeve 50.

A latch 70 is pivotally secured in the housing 10 at a pivot shaft 71 and includes an arm 72 for engaging with the extension 64 of the knob 60 and includes a limb 73 having a hook 731 for engaging with the trigger 20 (FIG. 2) and for preventing the trigger 20 from being actuated. A space 74 (FIG. 2) is formed between the arm 72 and the limb 73 of the latch 70 for receiving the extension 64 of the knob 60 and for allowing the extension 64 of the knob 60 to act onto the arm 72 and the limb 73 of the latch 70.

In operation, as shown in FIG. 2, when the knob 60 has not been moved, the hook 731 of the latch 70 is engaged with the trigger 20 for preventing the trigger 20 from being depressed inadvertently by the children. As shown in FIG. 3, when the knob 60 is moved forward for a distance x until engaging with the front end 52 of the sleeve 50, the plug 31 and the tube 40 has not been moved by the knob 60 via the sleeve 50 at this moment, such that the plug 31 is still engaging with the valve seat 38 and such that the gas still may not flow into the aperture 34 of the plug 31 and the pipe 41. At this moment, the arm 72 of the latch 70 is rotated by the extension 64 of the knob 60 to disengage the hook 731 of the latch 70 from the trigger 20, such that the trigger 20 may be actuated at this moment. But, the gas still may not be supplied into the pipe 41, such that the lighter may not be actuated by the children inadvertently at this moment.

Figure 4:
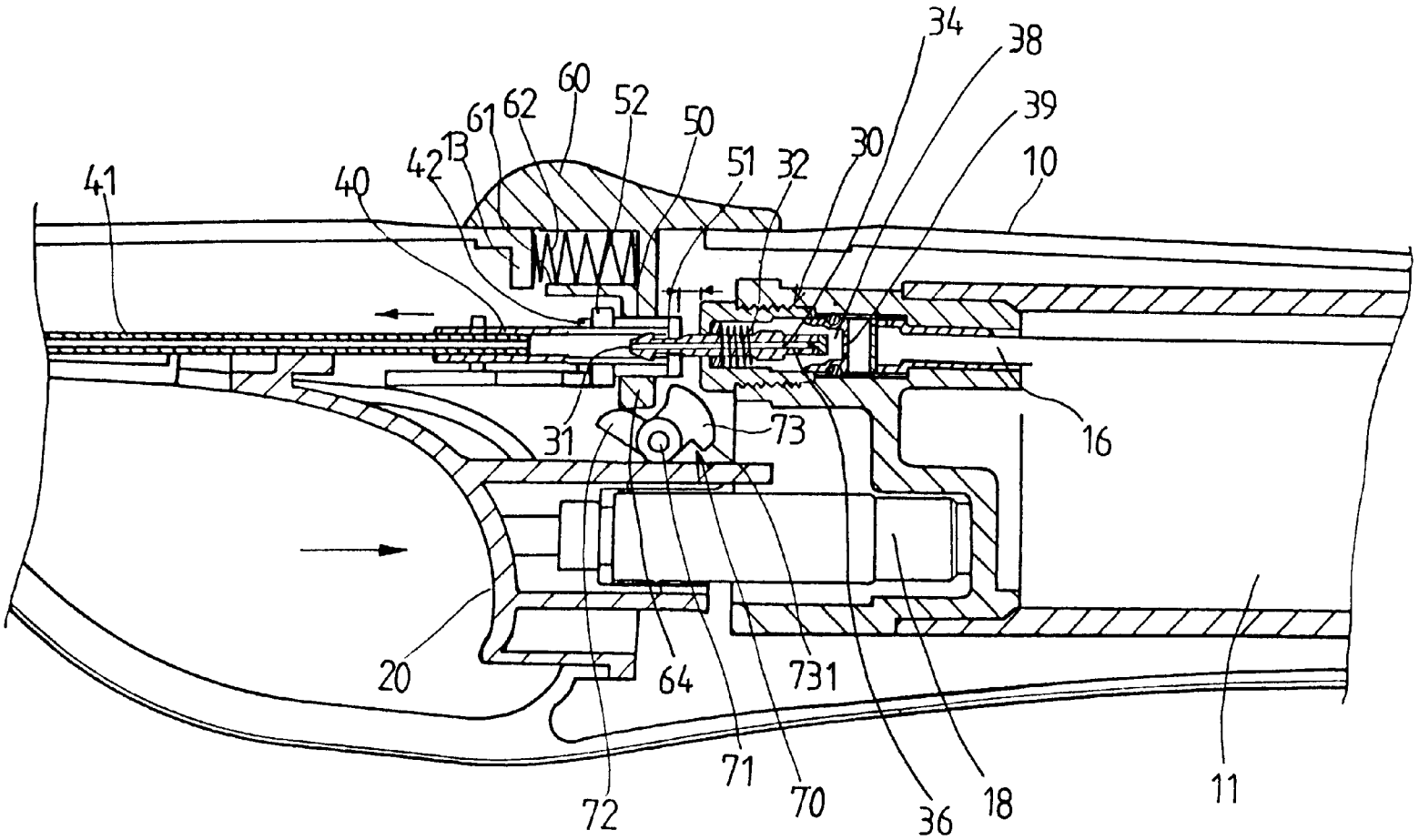

As shown in FIG. 4, when the knob 60 is further moved forward to move the sleeve 50 and the tube 40 and the plug 31 forward until the front end 52 of the sleeve 50 is engaged with the bearing 42, the rear end of the plug 31 is disengaged from the valve seat 38 such that the gas may flow into the aperture 34 of the plug 31 via the inlet 36 and may then flow into the pipe 41 via the tube 40. The lighter may then be ignited by depressing or actuating the trigger 20 to act on the igniting device 18. The trigger 20 may be released once the lighter is ignited. However, the knob 60 should be maintained at the forward position for disengaging the plug 31 from the valve seat 38. When the knob 60 is released, the spring 32 bias the plug 31 to engage with the valve seat 38 again for blocking the opening 39 such that the gas is blocked again and the gas thus may not be supplied to the pipe 41. The lighter thus includes a safety mechanism having two sections of protections for preventing the lighter from being ignited inadvertently by the children.

Accordingly, the lighter includes a safety mechanism for preventing the gas of the lighter from being ignited by the children inadvertently.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A lighter comprising:

a housing including a valve seat provided therein, a container received in said housing for receiving gas, an igniting device received in said housing, a trigger slidably received in said housing for engaging with and for actuating said igniting device, a plug slidably received in said housing and including an aperture formed therein, means for biasing said plug to engage with said valve seat and to prevent the gas from flowing into said aperture of said plug, the gas being allowed to flow into said aperture of said plug when said plug is moved against said biasing means, a latch pivotally secured in said housing and including a hook for engaging with said trigger and for preventing said trigger from being actuated, and a knob slidably received in said housing and engaged with said plug for disengaging said plug from said valve seat, said knob being engaged with said latch for disengaging said hook of said latch from said trigger when said knob is moved relative to said housing.

2. The lighter according to claim 1, wherein said housing includes a tube slidably received therein and a sleeve fixed to said tube, said plug includes a front end secured in said tube and includes a rear end for engaging with said tube, said knob includes an orifice formed therein for slidably receiving said sleeve, said sleeve includes a projection for engaging with said tube and for moving said tube and said plug to disengage said plug from said valve seat when said sleeve is moved by said knob.

3. The lighter according to claim 2, wherein said plug includes an inlet communicating said aperture of said plug with said valve seat.

4. The lighter according to claim 2, wherein said housing includes a bearing secured therein for slidably supporting said tube, said bearing is provided for engaging with said sleeve to limit a relative movement of said sleeve relative to said housing.

5. The lighter according to claim 1, wherein said knob includes an extension extended therefrom, said latch includes an arm and a limb extended therefrom, and includes a space formed between said arm and said limb for receiving said extension of said knob and for allowing said knob to act on said latch.

6. A lighter comprising:

a housing including a valve seat provided therein, a container received in said housing for receiving gas, an igniting device received in said housing, a trigger slidably received in said housing for engaging with and for actuating said igniting device, a plug slidably received in said housing and including an aperture formed therein, means for biasing said plug to engage with and to block said valve seat, the gas being allowed to flow into said aperture of said plug when said plug is moved against said biasing means, a tube slidably received in said housing, a sleeve fixed to said tube, said plug including a front end secured in said tube and including a rear end having a projection for engaging with said tube and for moving said tube and said plug to disengage said plug from said valve seat when said sleeve is moved, and a knob slidably received in said housing and engaged with said plug for disengaging said plug from said valve seat, said knob including an orifice formed therein for slidably receiving said sleeve, said knob being provided to engage with said tube and said plug and to disengage said plug from said valve seat when said sleeve is moved by said knob, said housing including a latch pivotally secured therein and having a hook for engaging with said trigger and for preventing said trigger from being actuated, and said knob being engaged with said latch for disengaging said hook of said latch from said trigger when said knob is moved relative to said housing.

7. The lighter according to claim 6, wherein said plug includes an inlet communicating said aperture of said plug with said valve seat.

8. The lighter according to claim 6, wherein said housing includes a bearing secured therein for slidably supporting said tube, said bearing is provided for engaging with said sleeve to limit a relative movement of said sleeve relative to said housing.

9. The lighter according to claim 6, wherein said knob includes an extension extended therefrom, said latch includes an arm and a limb extended therefrom, and includes a space formed between said arm and said limb for receiving said extension of said knob and for allowing said knob to act on said latch.

* * * * *